US008006664B2

(12) United States Patent
Lucas

(10) Patent No.: US 8,006,664 B2
(45) Date of Patent: Aug. 30, 2011

(54) DEVICE FOR SUPPLYING AIR TO A MULTIPLE-CYLINDER ENGINE HEAD

(75) Inventor: Jean-Christophe Lucas, Conflans Ste Honorine (FR)

(73) Assignee: Renault S.A.S., Boulogne Billancourt (FR)

( * ) Notice: Subject to any disclaimer, the term of this patent is extended or adjusted under 35 U.S.C. 154(b) by 644 days.

(21) Appl. No.: 12/089,442

(22) PCT Filed: Oct. 2, 2006

(86) PCT No.: PCT/FR2006/050977

§ 371 (c)(1),
(2), (4) Date: Sep. 24, 2008

(87) PCT Pub. No.: WO2007/042706

PCT Pub. Date: Apr. 19, 2007

(65) Prior Publication Data

US 2009/0301422 A1 Dec. 10, 2009

(30) Foreign Application Priority Data

Oct. 7, 2005 (FR) ..... 05 10292

(51) Int. Cl.
*F02M 35/10* (2006.01)

(52) U.S. Cl. ..... 123/184.36; 123/184.21; 123/184.44

(58) Field of Classification Search . 123/184.21–184.61
See application file for complete search history.

(56) References Cited

U.S. PATENT DOCUMENTS

| | | | | |
|---|---|---|---|---|
| 3,520,284 | A * | 7/1970 | Jantschke et al. | 123/184.34 |
| 4,372,120 | A * | 2/1983 | Ford et al. | 60/605.1 |
| 4,811,697 | A | 3/1989 | Kurahashi | |
| 4,901,681 | A * | 2/1990 | Pozniak et al. | 123/184.31 |
| 5,010,854 | A | 4/1991 | Suehiro et al. | |
| 5,048,471 | A * | 9/1991 | Takii et al. | 123/184.36 |
| 5,168,838 | A * | 12/1992 | Seike et al. | 123/184.31 |

FOREIGN PATENT DOCUMENTS

| | | |
|---|---|---|
| EP | 0 694 690 | 1/1996 |
| JP | 60 62654 | 4/1985 |

* cited by examiner

*Primary Examiner* — Michael Cuff
*Assistant Examiner* — Hung Q Nguyen
(74) *Attorney, Agent, or Firm* — Oblon, Spivak, McClelland, Maier & Neustadt, L.L.P.

(57) ABSTRACT

A device including two air distribution chambers configured to be fixed on a cylinder head and an air distributor and/or an air transfer pipe, the air transfer pipe and the air distribution chambers including, in the immediate surroundings of their nozzles, for being relatively positioned and assembled together: between the air distributor and one of the air distribution chambers, a positioning and supporting mechanism for support and precise relative centering, substantially without clearance, except for possible pivoting about the axis of engagement, once the centering has been provided along the axis, and, between the air distributor and the other air distribution chamber: an additional support mechanism and locating mechanism. A fixing mechanism locks, at the required swivel angle and in relative support, each air distribution chamber and the air distributor.

10 Claims, 3 Drawing Sheets

Figure 1:
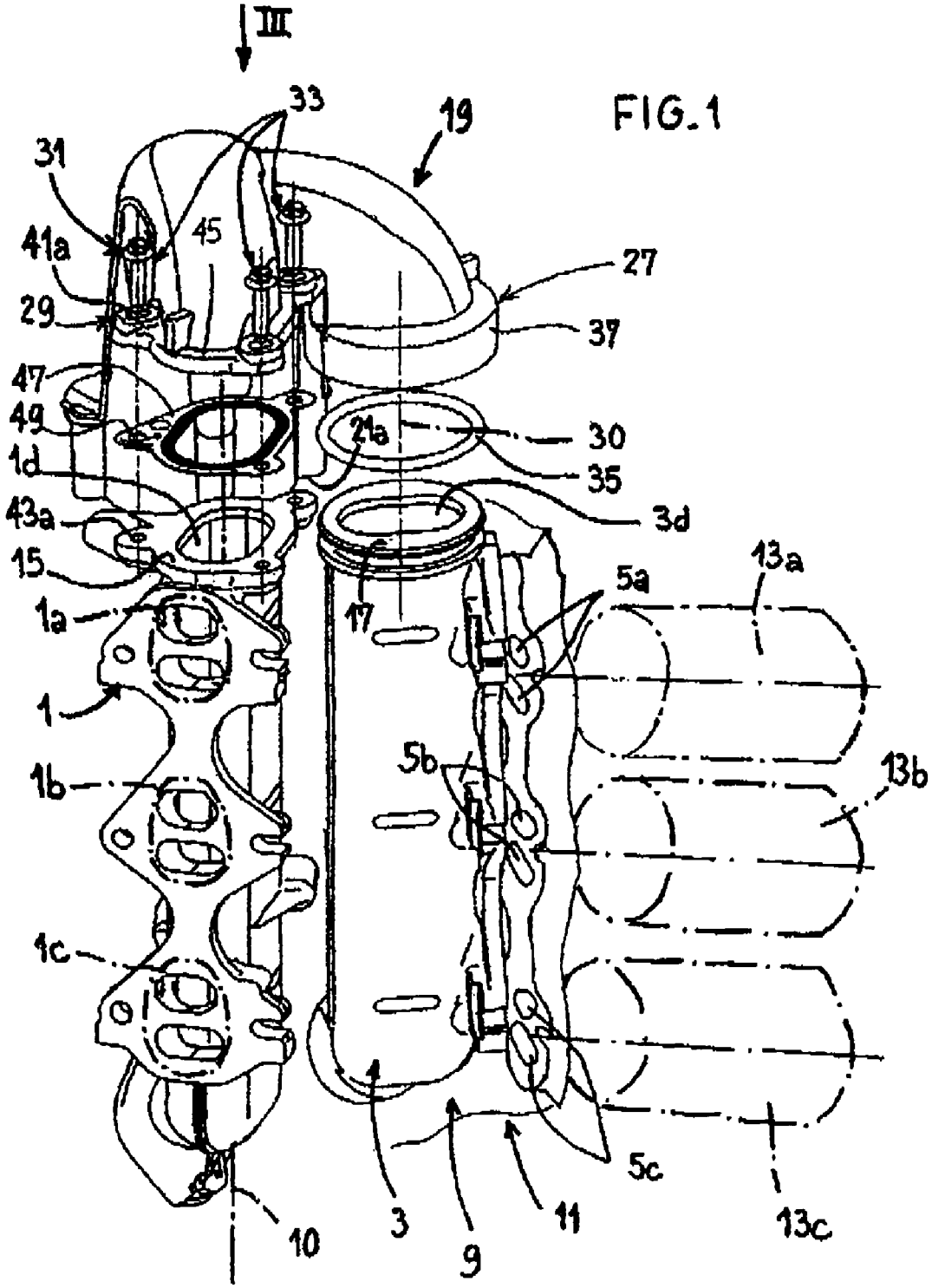

FIG.3
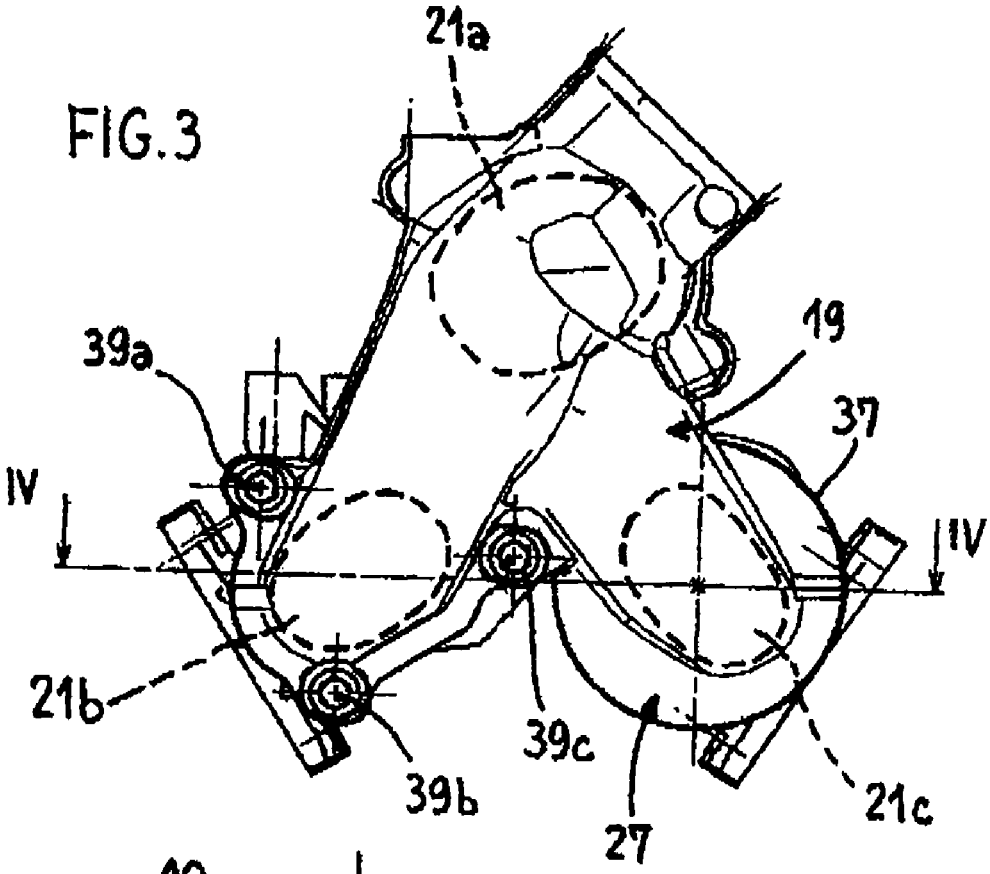
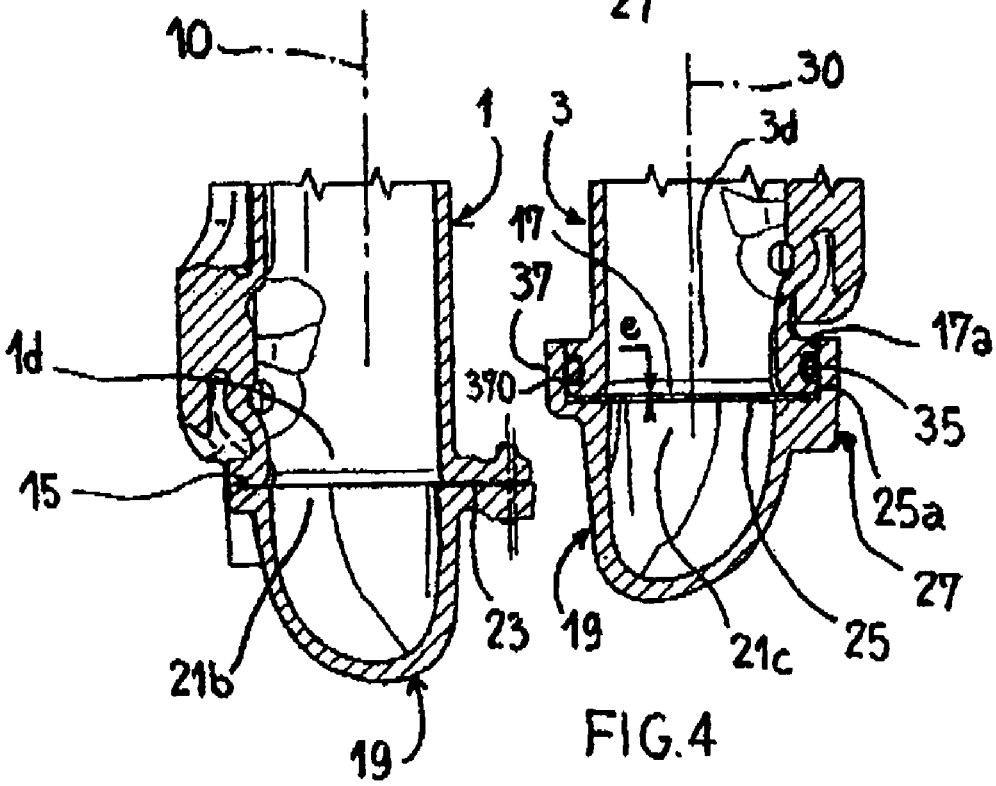
FIG.4

DEVICE FOR SUPPLYING AIR TO A MULTIPLE-CYLINDER ENGINE HEAD

The invention relates to a device for supplying air to the cylinder head of a multi-cylinder engine comprising two banks of air inlet ducts leading toward the cylinders.

In U.S. Pat. No. 4,895,112, as here, an air supply device such as this comprises one first and one second manifold, these manifolds being positioned or intended to be positioned and fixed on the cylinder head, along the air orifices of said air inlet ducts of this cylinder head, and which communicate with the combustion chambers of the cylinders.

Manifolds such as this formed of a first manifold and a second manifold are typically present on in-line V-engines, for example 6-cylinder engines.

The inlet manifolds are supplied with air via a splitter means.

In U.S. Pat. No. 4,895,112, the splitter means is incorporated into one of the inlet manifolds as a single piece and is connected in an airtight manner to the other inlet manifold via a push-fit connection using an O-ring to seal it.

This entails designing and producing the splitter and manifold concerned as one piece.

This is a solid component.

This can also present problems of fitting and make it more difficult to perform maintenance operations on the engine, for example during servicing.

It is an object of the invention to propose a solution:

- which makes it possible to reduce the volume of the relevant components that have to be produced,
- that makes it easier, on certain engines, to fit these air supply means (in this instance the manifolds and the splitter means), particularly in the case of V-engines and/or in-line engines,
- and which ensures appropriate positioning, centering and attachment of the various components concerned relative to one another, allowing favorable conditions of intervention that are compatible with mass-production and isostatic assembly.

To this end, it is proposed that the aforementioned air supply device, which therefore comprises a first and a second manifold, should further comprise, to replace the splitter means incorporated into one of these manifolds, a splitter comprising at least two air orifices positioned or intended to be positioned facing the relevant air orifice of said manifolds, respectively, this independent splitter and the manifolds further comprising, in the immediate surroundings of their said orifices, and in order to ensure the required relative positioning and the joining-together:

- of: the splitter and one of the manifolds, positioning and pressing first complementary means with sliding pivoting about an axis of engagement between this splitter and the manifold, with substantially play-free precise relative centering along this axis of engagement, the possibility of pivoting about said axis and translational movement along this same axis,
- and, of: said splitter and the other manifold:
- positioning and pressing second complementary means comprising:
- additional pressing means,
- and locating means for preventing pivoting about said axis of engagement once the relative angle of pivoting needed to ensure said required positioning between the splitter and the manifolds has been reached,
- and fixing third complementary means for immobilizing the splitter and the corresponding manifold pressing against one another at said required angle of pivoting.

Thus, the means of supplying the cylinders with air will therefore, on the whole, comprise three main components: the splitter upstream and the two manifolds downstream, with optimized positioning, centering and joining means.

To improve the supply of air to the manifolds, and therefore to the cylinders, particularly on V-engines and/or in-line engines, it is advisable that the manifolds each be connected, at a first end of their direction of elongation, to an upstream splitter and/or, at a downstream second end, the opposite end to the first, to an air transfer pipe that encourages good distribution of the air at this point.

Here, either one of the "splitter" and "air transfer pipe" may be produced as before and it is advisable for this embodiment to be applied preferably at least to the (upstream) intake splitter which will therefore comprise several internal ducts (in theory split into three) with three air orifices, one receiving air from the outside (typically from a throttle body), the other two therefore being intended to be positioned facing the corresponding air orifice of the manifolds.

In the preferred embodiment, it is advisable that both the aforementioned upstream splitter and the aforementioned downstream air transfer pipe be produced with the positioning, centering and joining means set out hereinabove.

Thus, this part of the engine will be made all the more accessible when it is being assembled, while at the same time ensuring that this assembly will perform well and be isostatic.

As a preference, the positioning first complementary means with sliding pivoting for positioning the relevant splitter and manifold relative to one another will comprise an annular skirt projecting around the corresponding orifice of the splitter, this skirt closely covering an external edge of the corresponding orifice of the manifold facing it in order to allow the two to be pushed together with practically no radial play along said axis of engagement.

This solution makes it possible, in a simple way, to obtain a precise positioning and precise centering of the two components, as well as ensuring that they are held together firmly, at the site of their said air orifices, while at the same time allowing these components to move freely in terms of axial translation and in terms of rotation as desired with respect to the axis along which they are engaged, until such time as this same splitter has been positioned and centered correctly with respect to the other manifold.

In order to seal the join between the splitter and each manifold concerned, it is further advisable:

- for an O-ring seal or a more or less O-shaped seal to be inserted at the location of said positioning first complementary means with sliding pivoting,
- and for a flat seal to be inserted at the location of the positioning and pressing second complementary means.

As far as the locating means are concerned, it is further advisable for them to comprise at least one screw passing through a hole of non-circular cross section.

This is a simple high-performance solution compatible with the well-mastered techniques used when mass-producing engines in the automotive field.

As far as the aforementioned fixing third complementary means are concerned, it is advisable for them to comprise screws passing through oblong holes formed on the splitter concerned, in the immediate surroundings of the corresponding orifice.

Again to encourage isostatic assembly, under conditions that are good both from a mechanical standpoint and in terms of cost and ergonomics, provision is also preferably made:

- for the positioning first complementary means with sliding pivoting to comprise a bore having a cross section adapted to provide said precise relative centering along the axis of engagement of the splitter with respect to the relevant manifold, and for the additional pressing means to comprise two pressing surfaces formed one on the splitter and the other on the other manifold, so that between them they form a flat pressing surface substantially perpendicular to the axis of engagement along which the aforementioned bore extends.

For the same reasons, it is also advisable for the fixing third complementary means to comprise three screws:

(at least) one of these screws preventing rotation and thus defining said locating means, in conjunction with a non-circular hole formed on at least one of either the splitter or the relevant manifold, these screws, furthermore, together fixing the splitter and the corresponding manifold tightly together while at the same time also immobilizing this splitter with respect to the other manifold.

Figure 2:
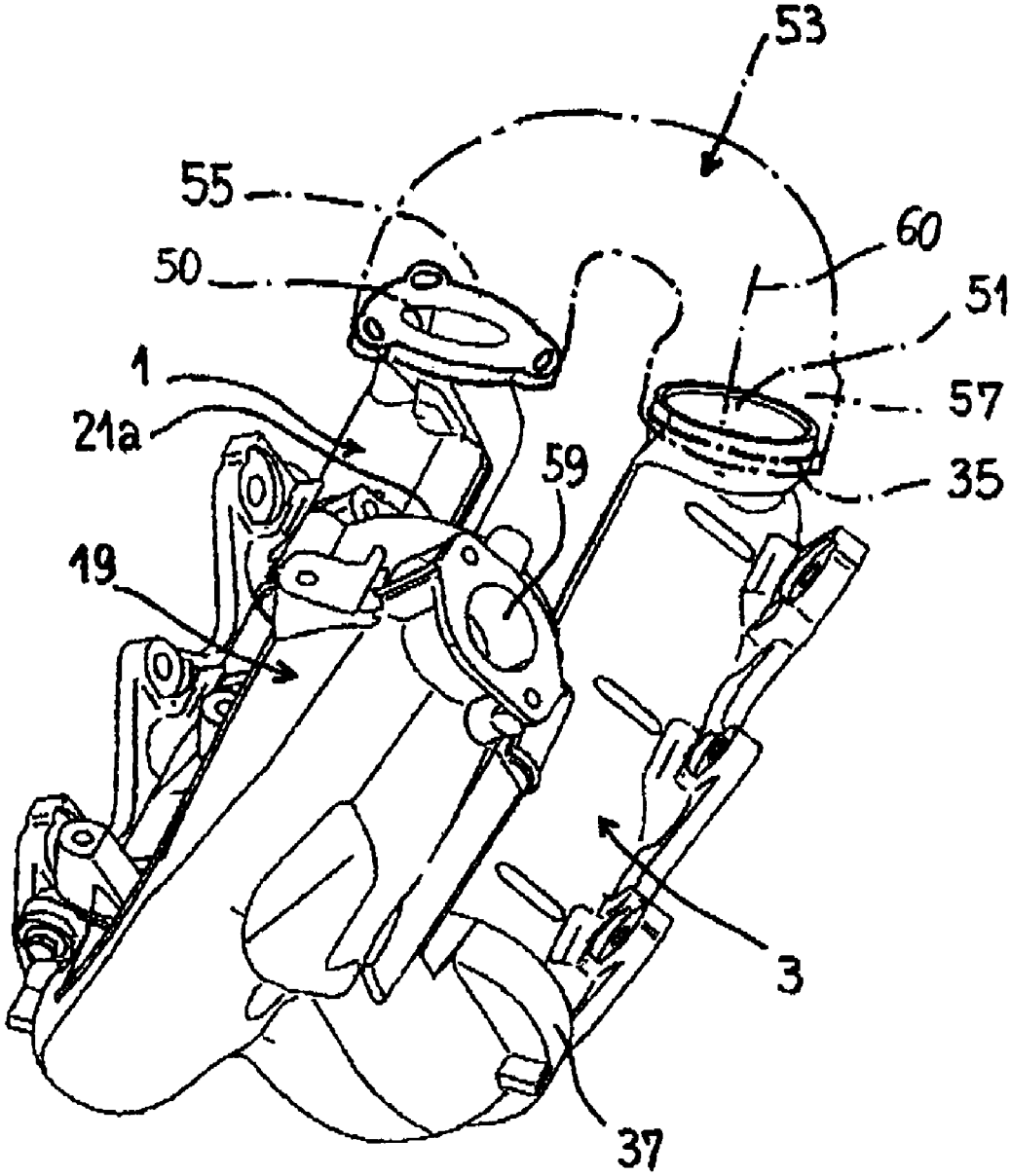

An even more detailed description of the invention will now be provided with reference to the attached drawings which are given by way of non-limiting example and in which:

FIG. 1 is a schematic perspective and exploded view of part of an engine according to the invention, FIG. 2 shows the three components consisting of the upstream air intake splitter and the two manifolds in the assembled position, the air transfer pipe being shown in ghost line at the top of the figure, which corresponds to a perspective view that is the opposite of that of FIG. 1, FIG. 3 is an end-on view, in the direction of arrow III of FIG. 1, of just the upstream air intake splitter, and FIG. 4 is a partial view, in section on IV-IV of FIG. 3, the connections between the splitter concerned and each manifold being depicted in isolation, independently of one another.

FIG. 1 shows two inlet manifolds 1, 3 designed, in a way known per se, to distribute the intake air to the two series of air intake orifices (referenced 5*a*, 5*b*, 5*c* in the case of one of them) in the cylinder head 9 of a multi-cylinder engine 11 that covers a cylinder block of the engine.

In this instance, it is a six-cylinder V-engine with the cylinders in banks, and therefore with two series of three groups of air intake orifices.

Three of the cylinders corresponding to one of the banks have been depicted schematically as 13*a*, 13*b*, 13*c*.

Each manifold 1, 3 comprises at least one air intake orifice and several orifices or groups of orifices for distributing or leading air to said corresponding air orifice in the cylinder head 9.

In FIG. 1, the three groups of orifices leading air from the manifold 1 to the cylinder head have been referenced 1*a*, 1*b*, 1*c*.

These three groups, each in this instance comprising two openings, are distributed parallel to the axis 10 of elongation of this manifold 1, which is also the axis of elongation of the internal duct reserved for the circulation of air through this manifold.

The same is true of the other manifold 3 (axis 30).

FIG. 1 shows the two air inlet orifices in the manifolds as 1*d* and 3*d*, these being one for each manifold 1, 3.

These orifices have terminal surfaces such as 15 in the case of the orifice 1*d*, which acts as a support, and 17 in the case of the orifice 3*d*, which, along the axis of engagement 30, leaves a clearance e with respect to the surface 25 opposite (see FIG. 4).

Regarding the splitter, referenced 19 in FIGS. 1, 3 and 4, there are three air orifices given that this here is an air intake splitter.

In FIG. 1, 21*a* is the reference for the air intake zone for air entering the splitter 19 (see also FIG. 3). The air is therefore admitted more or less parallel to the axes 10 and 30.

21*b* and 21*c* are the two air outlet orifices from the splitter 19, once again more or less in the directions 10 and 30 respectively.

Thus, the internal ducts that define a Y are each bent into a U.

In the two manifolds, as regards the pressing surface 15 and the surface 17 that is not in axial contact with its counterpart 25 (there is a small space e in the case of the manifold 3), these are respectively parallel to the pressing surface 23 and to the surface 25 of the corresponding outlet orifices 21*b*, 21*c* of the splitter concerned, as illustrated in FIG. 4 where it can be seen that there is therefore always a very small clearance between the surfaces 17 and 25.

In practice, these surfaces 17 and 25 will therefore, axially, be in close proximity to and facing one another when the components 1, 3 and 19 have been fixed together once they have been correctly positioned and centered according to the invention.

As a preference, said surfaces will be planes.

In the preferred example illustrated, these planes are perpendicular to the axis 10 or 30 considered, the axis 30 constituting the axis of engagement along which the outlet orifice of the splitter 19 will be offered up to and, in this instance, engaged on, the orifice 3*d*, with a sliding pivot connection.

Thus, said pressing surfaces or planes will collaborate in pairs with one another to connect and correctly position the splitter 19 with respect to each of the two manifolds 1, 3, with the relevant orifices and surfaces pressing against one another or facing one another.

In order to position, center and fix the splitter 19 with respect to the two manifolds firmly and isostatically, these collaborating surfaces are supplemented by:

between the splitter and the manifold 3: a push-fit connection 27 that allows only a situation of sliding pivoting between these two components, this being after these components have been engaged one inside the other along the axis of engagement 30; and between said splitter 19 and the other air manifold 1: an additional pressing means 29 supplemented by locating means 31, this being once the relative angle of pivoting needed to ensure the required positioning between the splitter 19 and the manifolds 1, 3 has been reached, as well as fixing means 33 used once the push-fit connection 27 has been made and the position, which is therefore the axial position of the surfaces 17 and 25 relative to one another has moreover been established.

As far as the pressing surfaces of the splitter 19 and the manifold 3 that press against one another are concerned, while there is therefore no axial pressure between the surfaces 17 and 25, this pressure does exist laterally, at the site of, the corresponding adjacent lateral surfaces 17*a* and 25*a* respectively (see FIG. 4) at the point where the sealing gasket 35 is fitted, in this instance an O-ring seal or a substantially O-shaped seal (bearing in mind the possibility that the relevant orifices will be of ovalized shape).

The push-fit connection 27 is preferably performed, as illustrated by FIGS. 1, 3 and 4, by a skirt 37 formed around the orifice 21*c*, this being over the entire periphery of the corresponding end flange.

When the splitter 19 is offered up to the manifold 3 along the axis of engagement 30, this skirt 37 tightly and externally covers the end of the orifice 3*d* of the manifold, until the end surfaces 17, 25 have therefore been positioned axially as close together as possible as explained hereinabove, the seal 35 then being radially compressed.

Once this operation of positioning and of centering said components along the axis 30 has been performed, with the freedoms of rotation about this axis and of translational movement along this same axis which remain in respect of the splitter 19, centering and fixing in respect of the other manifold 1 can then be performed.

To do this, use is made of three screws 39*a*, 39*b*, 39*c* at least some of which can pass with clearance (when not tightened) through two series of three holes, such as 41*a* and 43*a* in the case of the screw 39*a* which will be used to provide the desired locating effect in conjunction with the corresponding opening 41*a* and its counterpart 43*a*, said holes being formed through the flange on one side of the orifice 1*d* and on the other side of the orifice 21*b*, and therefore through the aforementioned surfaces 15 and 23 that are transverse to the axis 10 common to these two orifices.

In this instance, the threads of the screws 39*a*, 39*b*, 39*c* engage with tappings formed in the three holes (such as 43*a*) in the flange 15 of the manifold 1.

The movement 29 is halted at the pressing surface 15 by engagement of the screws in their holes, such as the hole 41*a*, here formed in the external flange 45 of the splitter.

Thus, when the bore 370 at the site of the skirt 37 of the complementary positioning means (17, 17*a*, 25*a*, 37) participates, with the opposing end of the manifold 3, in the precise relative centering of the splitter and of this manifold along the axis of engagement 30 thereof, the freedoms of movement permitted by the sliding pivot connection will be halted at a flat bearing surface substantially perpendicular to the axis 30 of engagement of the bore, specifically between the two pressing surfaces 15, 23 formed on the splitter and the manifold 1 respectively and by the screws 33, with the locating means 31.

In order to prevent the splitter 19 from turning with respect to the manifold 1, the oblong hole (or hole of any other appropriate shape) 41*a* that accepts the relevant locating means has been produced precisely.

In this way, the pivoting about the axis 30 can be immobilized in the desired angular position along the bearing plane created between the surfaces 15 and 23 and between which the flat seal 47 has preferably been inserted before the screws were fitted (this seal having appropriate holes such as 49 through it and through which said screws can pass).

If the screw 39*a* is also used for locating purposes, the three screws here forming the fixing means 33 can then be tightened down onto the manifold 1, through their corresponding holes, in order to achieve the desired tight connection.

The aforementioned effect of play-free centering/prevention from rotating using the locating means adopted could, as an alternative, be performed for example by a stub shaft or an attached stud.

Furthermore, it will have been observed in FIG. 1 that the screw heads lie on the splitter 19 side and are therefore fastened into the manifold 1. The reverse could be true (with the screws fastening into the splitter).

At the longitudinal end that lies at the opposite end to the splitter 19 (along their respective axes 10, 30), the two manifolds 1, 3 could also be joined together by the same isostatic assembly system that acts without deformation of the components provided that there is, at this end, and as illustrated in FIG. 2, provision for their corresponding orifices 50, 51 to be connected using an air transfer pipe 53.

The positioning, centering and fixing means, which may be identical to those shown, have not been illustrated but given that they are identical to the aforementioned ones, it is easy to imagine how they might look.

This air transfer pipe 53 will therefore preferably bear the same positioning and centering means 27, 31, 33 (sliding pivoting, pressing surface, locating means) and fixing means as the splitter 19.

The axis of engagement (previously 30) between the air transfer pipe 53 and the manifold 3 has been referenced 60.

The difference between the splitter 19 and the air transfer pipe 53 here is related to their internal construction. The splitter 19 here comprises three main air ducts: one for intake (to which its air intake aperture 21*a* opens) and the other two conveying air to the respective outlet orifices 21*b* and 21*c*, these three ducts of course communicating with one another within the splitter.

The air transfer pipe 53 contains just one duct, with one aperture, 55 and 57 respectively, at each end, in order therefore to allow the air to flow between the two manifolds 1 and 3, at the opposite end to the inlet splitter 19.

In FIG. 2, a recirculation (EGR) air inlet that may enter the air intake splitter 19 transversely has been featured as item 59.

The invention claimed is:

1. A device for supplying air to a cylinder head of a multi-cylinder engine including two banks of air inlet ducts leading toward the cylinders, the ducts including inlet orifices, the air supply device comprising:

one first and one second manifold, the manifolds positioned or configured to be positioned and fixed on the cylinder head, along the inlet orifices of the air inlet ducts, each manifold comprising, at a first end, an air orifice;

a splitter comprising at least two air orifices positioned or configured to be positioned facing the air orifice of the respective manifolds, the splitter and the manifolds comprising, in immediate surroundings of their orifices, to ensure required relative positioning and the joining-together:

of: the splitter and one of the manifolds, positioning first complementary means with sliding pivoting along an axis of engagement between the splitter and the manifold, with substantially play-free precise relative centering, along the axis, the possibility of pivoting about the axis and translational movement along the same axis, and, of: the splitter and the other manifold:

positioning and pressing second, complementary means comprising:

additional pressing means, and locating means for preventing pivoting about the axis of engagement once a required relative angle of pivoting needed to ensure the required positioning between the splitter and the manifolds has been reached, and fixing third complementary means for immobilizing the splitter and the corresponding manifold pressing against one another at the required angle of pivoting.

2. The air supply device as claimed in claim 1, wherein the splitter comprises plural internal ducts including three air orifices, one receiving air from the outside to supply air to the manifolds, the other two therefore configured to be positioned opposite the corresponding air orifice of the manifolds.

3. The air supply device as claimed in claim 1, wherein:

each manifold comprises, at a second end, a second air orifice to allow air to flow between the manifolds, an air transfer pipe provided at the second end, with two air orifices positioned or configured to be positioned one against each manifold, facing the second air orifices thereof, to allow air to flow between the manifolds through the air transfer pipe.

4. The air supply device as claimed in claim 3, wherein the air transfer pipe and the manifolds comprise, in immediate surroundings of their orifices, to ensure the required relative positioning and the joining-together:

of: the air transfer pipe and one of the manifolds, positioning fourth complementary means with sliding pivoting about an axis of engagement between the air transfer pipe and the manifold, with substantially play-free precise relative centering, along the axis, the possibility of pivoting about the axis and translational movement along the same axis, and, of: the air transfer pipe and the other manifold:

positioning and pressing fifth complementary means comprising:

additional pressing means, and locating means for preventing pivoting about the axis of engagement once the relative angle of pivoting needed to ensure the required positioning between the splitter and the manifolds has been reached;

and fixing sixth complementary means for immobilizing the splitter and the corresponding manifold pressing against one another at the required angle of pivoting.

5. The air supply device as claimed in claim 1, wherein the positioning first complementary means with sliding pivoting comprises an annular skirt projecting around the corresponding orifice of the splitter, the skirt closely covering an external edge of the corresponding orifice of the manifold concerned to allow the two to be pushed together with practically no radial play along the axis of engagement.

6. The air supply device as claimed in claim 1, wherein:

an O-ring seal or a more or less O-shaped seal is inserted at a location of the positioning first complementary means with sliding pivoting, and a flat seal is inserted at the location of the positioning and pressing second complementary means.

7. The air supply device as claimed in claim 1, wherein the locating means comprises at least one screw passing through a hole of non-circular cross section.

8. The air supply device as claimed in claim 1, wherein the fixing third complementary means comprises screws passing through holes formed on the splitter, in immediate surroundings of the corresponding orifice.

9. The air supply device as claimed in claim 1, wherein:

the positioning first complementary means with sliding pivoting comprises a bore that provides precise relative centering along the axis of engagement of the splitter with respect to the relevant manifold, and the additional pressing means comprises two pressing surfaces formed one on the splitter and the other on the other manifold, so that between them they form a flat pressing surface substantially perpendicular to the axis of engagement of the bore.

10. The air supply device as claimed in claim 1, wherein the fixing third complementary means comprises three screws:

one of the screws preventing rotation and thus defining the locating means, in conjunction with a non-circular hole formed on at least one of either the splitter or the relevant manifold, the screws together fixing the splitter and the corresponding manifold tightly together while at the same time also immobilizing the splitter with respect to the other manifold.

* * * * *